US006568062B1

(12) United States Patent
Opper et al.

(10) Patent No.: US 6,568,062 B1
(45) Date of Patent: May 27, 2003

(54) METHODS OF REMOVING SELF-PIERCING RIVETS SET INTO A WORKPIECE AND DEVICES FOR IMPLEMENTING THE METHODS

(75) Inventors: Reinhold Opper, Alten-Buseck (DE); Dieter Mauer, Lollar (DE)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 09/648,296

(22) Filed: Aug. 28, 2000

Related U.S. Application Data

(63) Continuation-in-part of application No. 09/099,142, filed on Jun. 18, 1998, now Pat. No. 6,108,890.

(30) Foreign Application Priority Data

Jun. 19, 1997 (DE) ..... 197 26 104
Mar. 16, 2000 (DE) ..... 100 12 845

(51) Int. Cl.[7] ..... B23P 19/00

(52) U.S. Cl. ..... 29/426.5; 29/414; 29/566; 408/24; 219/603; 219/610; 219/617; 227/63

(58) Field of Search ..... 29/426.5, 34 B, 29/447, 243.53, 413, 414, 566; 219/121.11, 603, 600, 607, 610, 616, 617; 228/141.1, 144; 408/1 R, 24, 30, 22; 227/63

(56) References Cited

U.S. PATENT DOCUMENTS 2,375,112 A * 5/1945 Kanihan
2,409,589 A * 10/1946 Rocheville
3,182,173 A * 5/1965 Dash
4,918,798 A * 4/1990 Reed
5,228,811 A * 7/1993 Potter
5,318,390 A * 6/1994 DalBianco
5,502,291 A * 3/1996 Cummings
6,092,964 A * 7/2000 El Desouky et al.
6,330,738 B1 * 12/2001 Yoshikawa et al.

FOREIGN PATENT DOCUMENTS

DE 197 01 780 * 7/1998
GB 636343 * 4/1950

* cited by examiner

*Primary Examiner*—Gregory Vidovich
*Assistant Examiner*—Eric Compton
(74) *Attorney, Agent, or Firm*—Edward D. Murphy

(57) ABSTRACT

A through-hole self-piercing rivet 30 is assembled with two metal plates 50 and 52 to retain the plates together as a workpiece 54. When the rivet 30 is to be removed, a pin, such as a contact pin 56, is attached to the rivet by fusion, or a pin, such as a threaded mandrel 78, is attached threadedly to the rivet. The contact pin 56 or the threaded mandrel 78 is withdrawn from the workpiece 54 to thereby withdraw the attached rivet 30 from the workpiece. Devices 62 and 84 provide facility for effecting the attachment of the contact pin 56 and the threaded mandrel 78, respectively, with the rivet 30, and for the extraction of the rivet from the workpiece 54.

13 Claims, 7 Drawing Sheets

METHODS OF REMOVING SELF-PIERCING RIVETS SET INTO A WORKPIECE AND DEVICES FOR IMPLEMENTING THE METHODS

This application is a continuation-in-part of U.S. Ser. No. 09/099,142, filed Jun. 18, 1998, now U.S. Pat. No. 6,108,890 the disclosure of which is incorporated herein by reference thereto.

BACKGROUND OF THE INVENTION

This invention relates to methods of removing self-piercing rivets set into a workpiece, and to devices for implementing the methods. In particular, this invention relates to methods of removing through-hole rivets set in a workpiece, and to devices for implementing the methods.

A through-hole self-piercing rivet has a first opening and a second opening formed in spaced portions of an outer surface thereof and a passage extending between and in communication with the first and second opening. An example of a through-hole self-piercing rivet is a tube-shaped self-piercing rivet shown in German Patent Application No. DE 197 01 780. The tube-shaped self-piercing rivet is formed with an axially symmetric design with a cutting edge at each of a leading axial end and a trailing axial end thereof. During the riveting process, the cutting edge of the leading axial end pierces a workpiece, while the cutting edge of the trailing axial end is deformed outwardly so that a riveted joint is produced thereby.

Producing riveted joints with such tube-shaped self-piercing rivets results in essentially permanent connection of, for example, two metal sheets, which are to be riveted together, and in the context of this description, form the workpiece into which the tube-shaped self-piercing rivet is set. In order to detach the riveted metal sheets from one another, such as, for example, in the case of essential repair work, the riveted joint has to be undone. This is usually accomplished by a chisel-like tool, or the like, which is driven between the metal sheets so that the rivet connecting the metal sheets is torn forcibly out of its seat. The result is not only destruction of the rivet but also deformation of the workpiece, i.e., the two metal sheets, at the point where the rivet is torn out, which is undesirable and makes it necessary to machine the relevant sheets when re-use of at least one sheet is required. Further, this method is undoing the riveted joint is a costly and uncontrollable operation which is also rendered more difficult by the fact that riveted joints are often situated in accessible places.

Therefore, there is a need for methods which will facilitate the removal of the tube-shaped self-piercing rivets set into a workpiece, and for devices which implement such methods.

SUMMARY OF THE INVENTION

It is, therefore, an object of this invention to provide methods of removing tube-shaped self-piercing rivets from a workpiece.

Another object of this invention is to provide devices for implementing methods of removing tube-shaped self-piercing rivets from a workpiece.

With these and other objects in mind, this invention contemplates a method of removing a self-piercing rivet from a set position in a workpiece. The self-piercing rivet has a first opening and a second opening formed in spaced portions of an outer surface thereof and a passage extending between and in communication with the first and second opening. The self-piercing rivet is further formed with an attachable portion. The method of removing the self-piercing rivet includes the steps of placing a pin adjacent the attachable portion of the self-piercing rivet, attaching the pin to the attachable portion of the self-piercing rivet, applying a force to the workpiece by an abutment supported on the workpiece, and retracting the pin and the attached self-piercing rivet from the workpiece counter to the applying of the force to the workpiece, whereby the self-piercing rivet is withdrawn from the workpiece.

This invention further contemplates a method of removing a self-piercing rivet from a set position in a workpiece. The self-piercing rivet has a first opening and a second opening formed in spaced portions of an outer surface thereof and a passage extending within the self-piercing rivet between and in communication with the first and second openings. The self-piercing rivet is further formed with an attachable portion. The method includes the steps of placing a pin in engagement with the attachable portion of the self-piercing rivet to provide a contact area between the pin and the self-piercing rivet, heating the contact area between the pin and the self-piercing rivet to a fusion temperature, cooling the contact area, applying a force to the workpiece by an abutment supported on the workpiece, and retracting the pin and the attached self-piercing rivet from the workpiece counter to the applying of the force to the workpiece, whereby the self-piercing rivet is withdrawn from the workpiece.

Additionally, this invention contemplates a method of removing a self-piercing rivet from a set position in a workpiece. The self-piercing rivet has a first opening and a second opening formed in spaced portions of an outer surface thereof and a passage extending between and in communication with the first and second openings. The self-piercing rivet is further formed with an attachable portion located on a wall of the passage. The method includes the steps of removing at least portions of the workpiece, previously located within the passage of the self-piercing rivet when the self-piercing rivet was assembled with the workpiece, to expose the attachable portion located on the wall of the passage of the self-piercing rivet, attaching a pin to the attachable portion of the self-piercing rivet, applying a force to the workpiece by an abutment supported on the workpiece, and retracting the pin and the attached self-piercing rivet from the workpiece counter to the applying of the force to the workpiece, whereby the self-piercing rivet is withdrawn from the workpiece.

Still further, this invention contemplates a device for implementing the removal of a through-hole self-piercing rivet from a workpiece, where the rivet has a first opening and a second opening formed in spaced portions of an outer surface thereof and a passage extending therebetween, which includes a pin, means for attaching the pin to an attachable portion of the through-hole self-piercing rivet, and means for retracting the pin, with the self-piercing rivet attached thereto, from the workpiece.

Also, this invention contemplates a device for implementing the removal of a through-hole self-piercing rivet from a workpiece, where the rivet has a first opening and a second opening formed in spaced portions of an outer surface thereof and a passage extending therebetween, which includes a pin, means for placing the pin in contact with an attachable portion of the through-hole self-piercing rivet at a contact area, means for heating the contact area to a fusion temperature to fuse and attach together the pin and the attachable portion of the rivet, means for cooling the heated contact area, and means for retracting the pin, with the self-piercing rivet attached thereto, from the workpiece.

This invention contemplates yet another device for implementing the removal of a through-hole self-piercing rivet from a workpiece, where the rivet has a first opening and a second opening formed in spaced portions of an outer surface thereof and a passage extending therebetween, which includes a pin, means for forming an attachable portion on the through-hole self-piercing rivet, means for attaching the pin to the attachable portion of the self-piercing rivet, and means for retracting the pin and the attached self-piercing rivet from the workpiece whereby the self-piercing rivet is withdrawn from the workpiece.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

Figure 1:
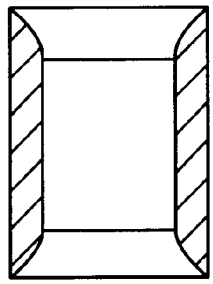
FIG. 1 is a sectional view showing a through-hole self-piercing rivet which is axially symmetrically formed.
Figure 2:
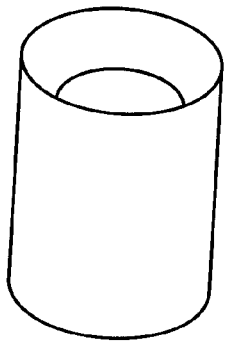
FIG. 2 is a perspective view showing the through-hole self-piercing rivet of FIG. 1.

Referring to FIG. 1, a self-piercing rivet 30 is formed with a first opening 32 and a second opening 34 formed in spaced portions of an outer surface 36, with a passage 38 extending between and in communication with the first and second openings. The rivet 30 is formed axially symmetric about an axis 40, and is formed with a stamping side 42 contiguous with the first opening 32 and a bottom side 44 contiguous with the second opening 34. Also, the rivet is formed with a circumferential cutting edge 46 at the stamping side 42 and a circumferential cutting edge 48 at the bottom side 44. The self-piercing rivet 30 is illustrated in perspective in FIG. 2.

Figure 3:
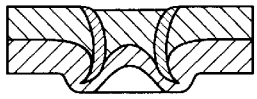
FIG. 3 is a sectional view showing an assembly of two metal sheets, forming a workpiece, held together by the through-hole self-piercing rivet of FIG. 1.
Figure 4:
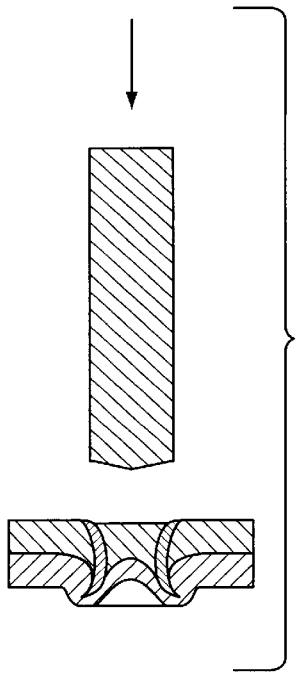
FIG. 4 is a sectional view showing the assembly of FIG. 3 with a contact pin located adjacent the through-hole self-piercing rivet.
Figure 5:
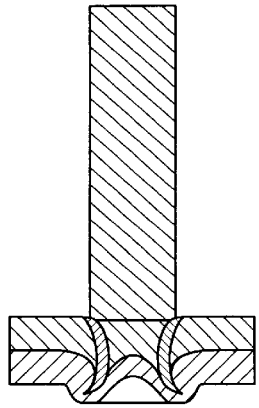
FIG. 5 is a sectional view showing the pin of FIG. 4 in contact with the assembled through-hole self-piercing rivet in accordance with certain principles of the invention.

As shown in FIG. 3, a riveted joint of two metal sheets 50 and 52, which form a workpiece 54, is effected by use of the self-piercing rivet 30. Referring to FIG. 4, a pin 56, referred to as a contact pin, is being moved toward the stamping side 42 of the self-piercing rivet 30 which is in assembly with the workpiece 54. As shown in FIG. 5, the contact pin 56 is moved into engagement with the stamping side 42 of the rivet 30. The area of contact between the contact pin 56 and the stamping side 42 of the rivet 30 is then heated, which can be accomplished, for example, by a welding process, to fuse, bond or connect together the engaging portions of the contact pin 56 and the stamping side 42 of the rivet 30.

Thus, the stamping side 42 of the self-piercing rivet 30 is an attachable portion of the rivet provided for attachment with the pin 56.

The connecting together of the contact pin 56 and the rivet 30 can be effected by arc welding, in the area of a bold line 58 (FIG. 5). The weld is effected in a manner customary when welding studs using arc welding. By retracting the contact pin 56 for several milliseconds, the necessary burning time was obtained to fuse together the adjacent portions of the pin and the rivet. The pin 56 is then lowered into the molten mass and a cooling is effected to provide a strong, loadable connection between the pin and the rivet 30.

Figure 6:
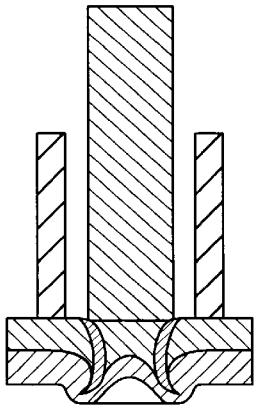
FIG. 6 is a sectional view showing an abutment in engagement with the workpiece and the contact pin of FIG. 4 in contact with the through-hole self-piercing rivet, in accordance with certain principles of the invention.
Figure 7:
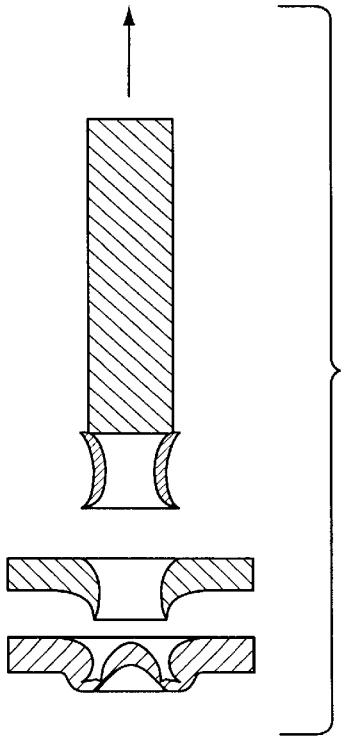
FIG. 7 is a sectional view showing the pin and the self-piercing rivet attached thereto being withdrawn from assembly with the two metal sheets, in accordance with certain principles of the invention.

Following the fusing operation, an abutment 60 is placed on the metal sheet 50 as shown in FIG. 6, and the contact pin 56 is withdrawn from the workpiece 54, in the direction shown in FIG. 7.

During the withdrawal of the contact pin 56, at least in the immediate area of the abutment 60, the metal sheet 50 and the metal sheet 52 encounter only specific residual damage thereof at the seat point of the rivet 30. The remaining region of the two metal sheets 50 and 52 are unaffected by the withdrawal process.

As shown in FIG. 7, as the pin 56 is withdrawn, the two metal sheets 50 and 52 are separated, and the rivet 30 remains attached to the pin. Thus, the two disassembled metal sheets 50 and 52 may be removed for further treatment, such as, for example, for recycling, with the only damage thereto being at the relevant point of the removal of the self-piercing rivet 30.

Figure 8:
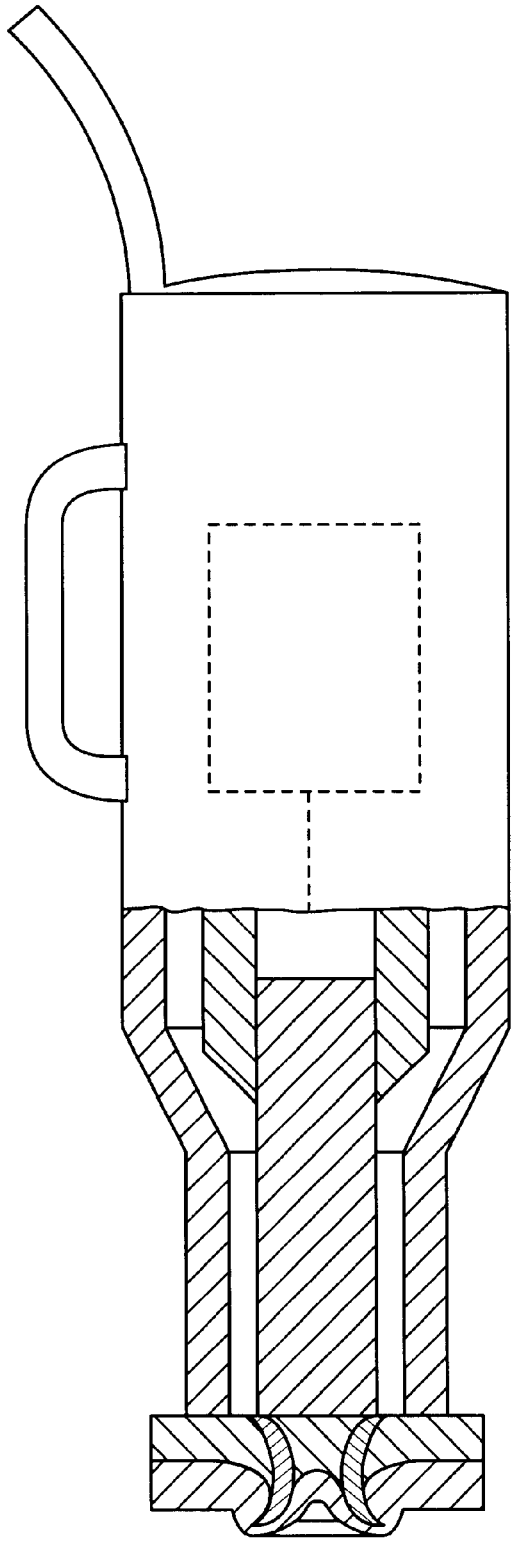
FIG. 8 is a partial sectional view of a device, which includes the pin of FIG. 4, used for implementing a method of removing the through-hole self-piercing rivet from the workpiece in accordance with certain principles of the invention.

Referring to FIG. 8, to produce the connection between the contact pin 56 and the self-piercing rivet 30 by arc welding, a device, such as a stud welding gun 62, is advantageously used. Such a stud welding gun is described, for example, in Great Britain Patent Specification No. GB 636 343. The stud welding gun 62 has a chuck 64, which grips the pin 56 and permits execution of the axial movements which are required during the arc welding. The movements are effected by a motion mechanism 66, which may be of various known types such as that shown in U.S. Pat. No. 5,502,291, the disclosure of which is incorporated herein by reference thereto. The motion mechanism 66 is housed in the interior of the stud welding gun 62.

A tool of the type shown in FIG. 8 may alternatively be used to produce a resistance weld, the tool merely having to be equipped with a suitable power supply and a suitable motion control program. Such tools are known.

Also, a tool of the type shown in FIG. 8 may be used for friction welding, wherein the motion mechanism 66 is a known type of rotary drive which sets the pin 56 held by the chuck 64 in rotation and presses the pin against the rivet 30 in the relevant contact area to produce a weld.

Figure 9:
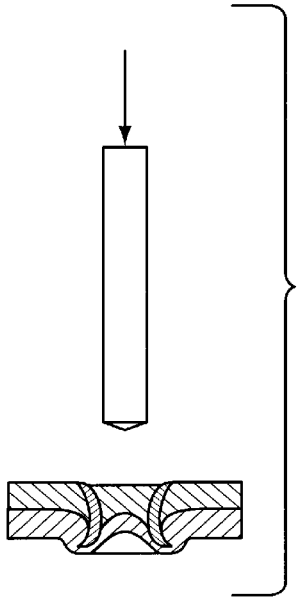
FIG. 9 is a sectional view showing a punch, or tappet, aligned with the assembly of FIG. 3 in accordance with certain principles of the invention.

Referring to FIG. 9, the workpiece 54, with the assembled self-piercing rivet 30 in place, is aligned with a pin, such as a punch or tappet 68, in a manner similar to the alignment of contact pin 56 with the workpiece and assembled rivet. The punch 68 is being advanced toward a portion 70 of the workpiece 54 which is confined within the passage 38 of the rivet 30. Ideally, the punch 68 is formed with a truncated cone 72 at an advancing end thereof closest to the workpiece to facilitate eventual penetration of the portion 70. It is noted that the advancing end of the punch 68 could be flat or concave, rather than as the truncated cone 72, without departing from the spirit and scope of the invention.

Figure 10:
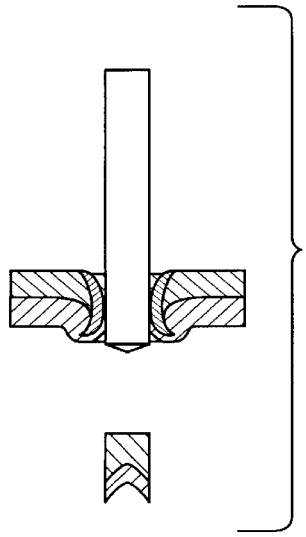
FIG. 10 is a sectional view showing the punch of FIG. 9 having punched a plug from the center or core of the through-hole self-piercing rivet in accordance with certain principles of the invention.

As shown in FIG. 10, the punch 68 is moved through the passage 38 of the assembled rivet 30 and, in the process, pushes or punches a punched plug 74 of the workpiece 54, which was formerly the portion 70 of the workpiece located within the passage of the rivet. With continued movement of the punch 68, the plug 74 is moved away from the workpiece 54 and the assembled rivet 30. The portion 70 of the workpiece 54 can also be removed by drilling through the passage 38 of the rivet 30 without departing from the spirit and scope of the invention.

Figure 11:
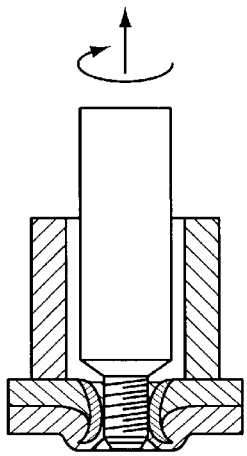
FIG. 11 is a sectional view showing a threaded mandrel being worked through, and threadedly attaching to, the core of the through-hole self-piercing rivet of FIG. 10 in accordance with certain principles of the invention.

The punch 68 is then removed and, as shown in FIG. 11, a rotating and axially-advancing feed screw 76, having a pin, formed as a threaded mandrel 78, at an advancing end thereof, is positioned to move the threaded mandrel into the passage 38 of the assembled rivet 30. Upon continued axial advancement and rotation, a wall of the passage of the rivet 30 is thereby threaded or furrowed, to create a threaded or form fitting connection with the mandrel 78.

Thus, the wall of the passage 38 forms the attachable portion of the self-piercing rivet 30.

Figure 12:
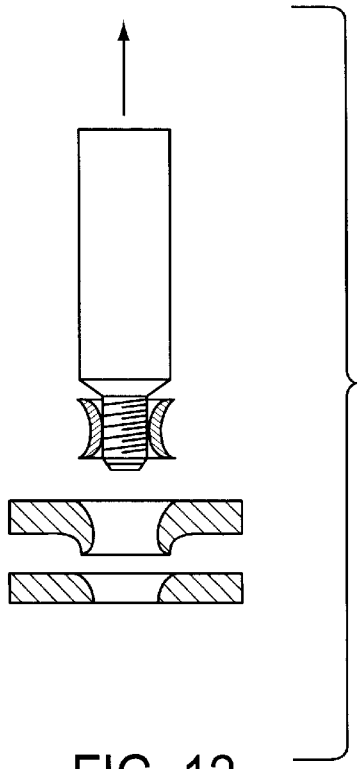
FIG. 12 is a sectional view showing the threaded mandrel and the threadedly attached self-piercing rivet being withdrawn from the two metal sheets in accordance with certain principles of the invention.

The abutment 60 is then positioned on the metal sheet 50 and, as shown in FIG. 12, the screw 76 and the mandrel 78 are withdrawn in the direction of the arrow 80. During this action, the rivet 30 is drawn against the retaining force of the abutment 60, whereby the rivet is extracted from the riveted joint, and the two metal sheets 50 and 52 are separated.

In this process, there is little chance that the metal sheet 50, adjacent the abutment 60, and the metal sheet 52 will be deformed, with only a limited degree of damage to the two metal sheets occurring at the seat of the rivet 30. The remaining area of the two metal sheets 50 and 52 remain unaffected by the removal process.

The solid connection created by the threading or furrowing between the threaded mandrel 78 and the self-piercing rivet 30 prevents the mandrel from being torn out of the rivet, with the result that the rivet is finally extracted from the riveted joint completely.

Figure 13:
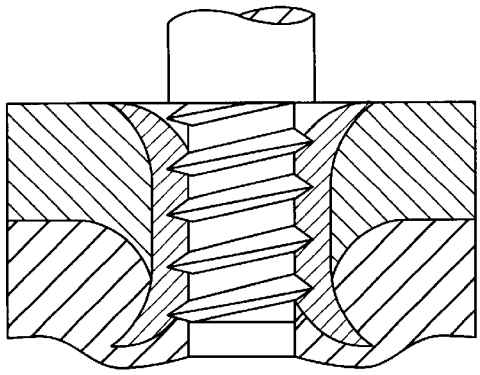
FIG. 13 is an enlarged sectional view showing the threaded attachment of the threaded mandrel of FIG. 11 in threaded attachment with the core of the through-hole self-piercing rivet in accordance with certain principles of the invention.

An enlarged illustration of the threaded mandrel 78 in its form-fitting connection with the self-piercing rivet 30 is illustrated in FIG. 13.

Figure 14:
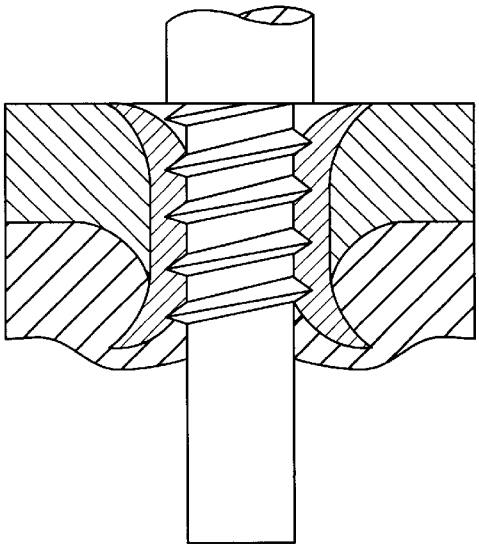
FIG. 14 is an enlarged sectional view showing the arrangement of FIG. 13 with a punch, or tappet, formed integrally with and extending from a forward portion of the threaded mandrel of FIG. 11 in accordance with certain principles of the invention.

Referring to FIG. 14, in another embodiment of the present invention, a punch 80 or tappet is formed forward of the threaded mandrel 78, and serves to punch or push the slug 74 (FIG. 10) from the assembled workpiece and rivet 30, immediately preceding the threaded or furrowed attachment of the mandrel with the rivet.

Figure 15:
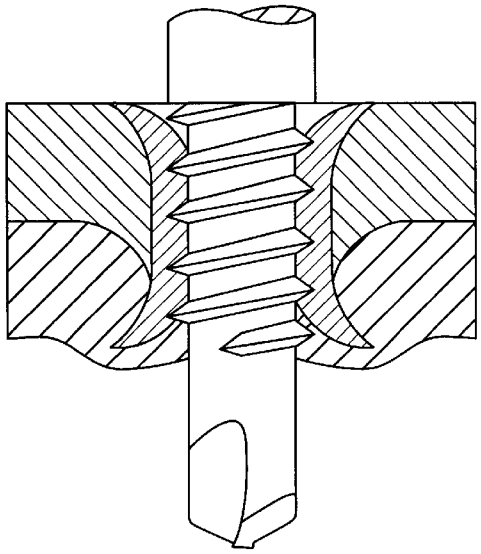
FIG. 15 is an enlarged sectional view showing the arrangement of FIG. 13 with a drill pin, or bit, formed integrally with and extending from a forward portion of the threaded mandrel of FIG. 11 in accordance with certain principles of the invention.

As shown in FIG. 15, in still another embodiment of the present invention, a drill bit 82 is formed forward of the threaded mandrel 78, and serves to drill through the portion 70 (FIG. 9) of the workpiece 54 and through the passage 38 of the rivet 30, immediately preceding the threaded or furrowed attachment of the mandrel with the rivet.

Figure 16:
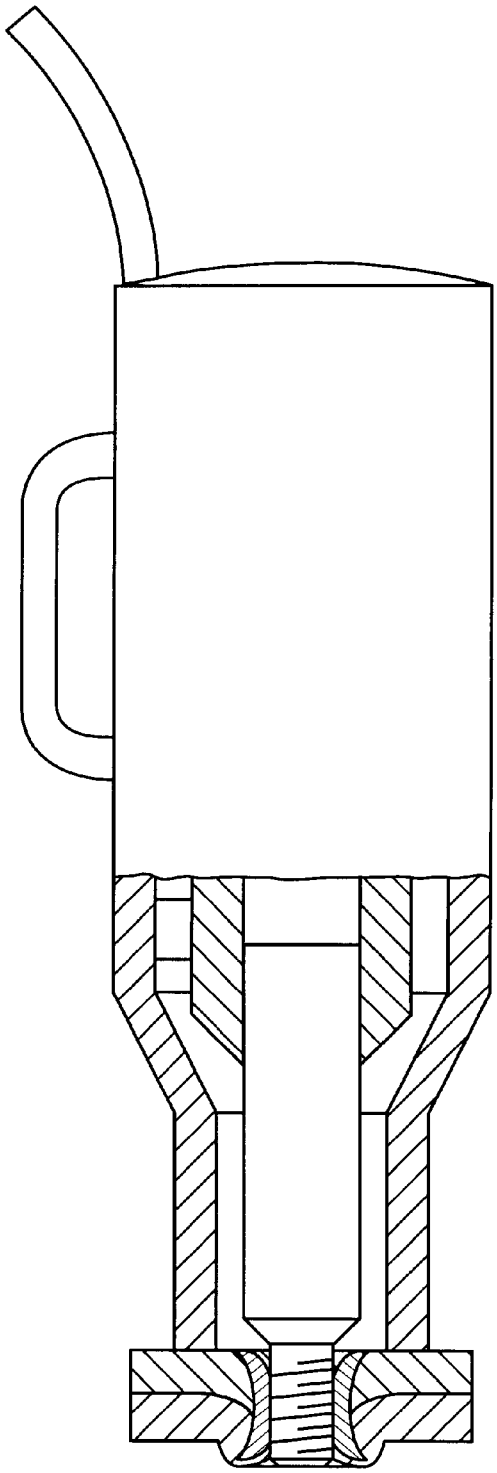
FIG. 16 is a partial sectional view showing a device, which includes the threaded mandrel of FIG. 11, used for implementing a method of removing the through-hole self-piercing rivet from the workpiece in accordance with certain principles of the invention.

Referring to FIG. 16, a device 84, according to the invention, is provided for extracting the rivet 30. To determine the path covered by the threaded mandrel 78, with the punch 80 or the drill bit 82 forward thereof, the device 84 includes a measuring a measuring device 86. The measuring device 86 is positioned in such a way that measurement of the rotating and pulling movements of the clamping jaws 64 or the feed screw 76 can be attained, so as to provide information on the specific movement executed by the threaded mandrel 78. A control circuit is connected between the measuring device 86 and a drive (not shown) of the device 84, and can provide process data on the device 84 by way of other sensors and can thereby assure a reliable and precise process for the extraction of the self-piercing rivet 30.

Figure 17:
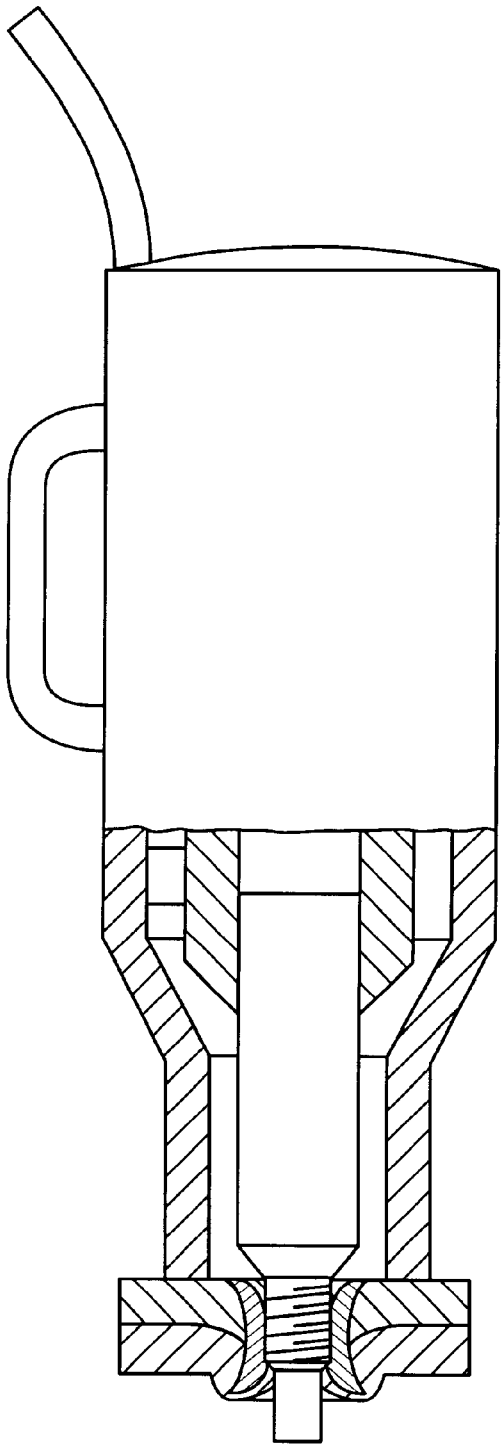
FIG. 17 is a partial sectional view showing the device of FIG. 16, which includes the threaded mandrel of FIG. 11, and the punch of FIG. 14 used for implementing a method of removing the through-hole self-piercing rivet from the workpiece in accordance with certain principles of the invention.

Referring to FIG. 17, the mandrel 78, with the punch 80, is shown with the device 84.

In general, the above-identified embodiments are not to be construed as limiting the breadth of the present invention. Modifications, and other alternative constructions, will be apparent which are within the spirit and scope of the invention as defined in the appended claims.

What is claimed is:

1. A method of removing a self-piercing rivet from a set position in a workpiece, wherein the self-piercing rivet has a first opening and a second opening formed in spaced portions of an outer surface thereof and a passage extending between and in communication with the first and second openings, the self-piercing rivet further formed with an attachable portion, which comprises the steps of:

placing a pin adjacent the attachable portion of the self-piercing rivet;

attaching the pin to the attachable portion of the self-piercing rivet;

applying a force to the workpiece by an abutment supported on the workpiece, and retracting the pin and the attached self-piercing rivet from the workpiece counter to the applying of the force to the workpiece, whereby the self-piercing rivet is withdrawn from the workpiece.

2. A method of removing a self-piercing rivet from a set position in a workpiece, wherein the self-piercing rivet has a first opening and a second opening formed in spaced portions of an outer surface thereof and a passage extending within the self-piercing rivet between and in communication with the first and second openings, the self-piercing rivet further formed with an attachable portion, which comprises the steps of:

placing a pin in engagement with the attachable portion of the self-piercing rivet to provide a contact area between the pin and the self-piercing rivet;

heating the contact area between the pin and the self-piercing rivet to a fusion temperature;

cooling the contact area;

applying a force to the workpiece by an abutment supported on the workpiece, and retracting the pin and the attached self-piercing rivet from the workpiece counter to the applying of the force to the workpiece, whereby the self-piercing rivet is withdrawn from the workpiece.

3. The method as set forth in claim 2, which further comprises the steps of:

supplying current through the pin; and producing fusion of the pin and the rivet by arc welding.

4. The method as set forth in claim 2, which further comprises the steps of:

supplying current through the pin; and producing fusion of the pin and the rivet by resistance welding.

5. The method as set forth in claim 2, which further comprises the steps of:

rotating the pin toward engagement with the rivet; and simultaneously applying pressure upon the rivet to produce friction welding of the pin with the rivet.

6. The method as set forth in claim 3, which further comprises the steps of:

moving the pin away from the rivet; and moving the pin back towards the rivet.

7. A method of removing a self-piercing rivet from a set position in a workpiece, wherein the self-piercing rivet has a first opening and a second opening formed in spaced portions of an outer surface thereof and a passage extending between and in communication with the first and second openings, the self-piercing rivet further formed with an attachable portion located on a wall of the passage, which comprises the steps of:

removing at least portions of the workpiece, previously located within the passage of the self-piercing rivet when the self-piercing rivet was assembled with the workpiece, to expose the attachable portion located on the wall of the passage of the self-piercing rivet;

attaching a pin to the exposed attachable portion of the self-piercing rivet;

applying a force to the workpiece by an abutment supported on the workpiece, and retracting the pin and the attached self-piercing rivet from the workpiece counter to the applying of the force to the workpiece, whereby the self-piercing rivet is withdrawn from the workpiece.

8. The method as set forth in claim 7, which further comprises the step of:

removing the at least portions of the workpiece by punching.

9. The method as set forth in claim 7, which further comprises the step of:

removing the at least portions of the workpiece by drilling.

10. A device for implementing the method as set forth in claim 7, wherein the pin is a threaded mandrel, and which comprises:

a drive device;

a chuck for clamping the threaded mandrel with the drive device;

means for advancing and rotating the chuck and the threaded mandrel toward the workpiece and the rivet; and an abutment surrounding the drive device.

11. The device as set forth in claim 10, which further comprises:

a punch extending from a free end of the threaded mandrel.

12. The device as set forth in claim 10, which further comprises:

a drill bit extending from a free end of the threaded mandrel.

13. The device as set forth in claim 10, which further comprises:

a feed screw for driving the threaded mandrel;

a sensor for measuring the advance of the feed screw;

the sensor for stopping the rotation of the feed screw in accordance with an adjustable degree of feed; and the sensor for switching the device to a return stroke operation.

* * * * *